US006019378A

United States Patent [19]

Cushing

[11] Patent Number: 6,019,378

[45] **Date of Patent: *Feb. 1, 2000**

[54] INLINE ROLLER SKATE AND WHEEL CONSTRUCTION

[76] Inventor: Vincent J. Cushing, 153 Williams Dr., Annapolis, Md. 21401

[ * ] Notice: This patent issued on a continued prosecution application filed under 37 CFR 1.53(d), and is subject to the twenty year patent term provisions of 35 U.S.C. 154(a)(2).

[21] Appl. No.: 07/890,785

[22] Filed: Jun. 1, 1992

[51] Int. Cl.[7] ..... A63C 17/00

[52] U.S. Cl. ..... 280/11.2; 188/5; 280/7.13; 280/11.22; 301/5.3

[58] Field of Search ..... 280/841, 843, 280/11.22, 11.23, 7.12, 7.13, 7.14; 301/5.3, 5.7, 6.1, 64.7; 188/4 R, 5

[56] References Cited

U.S. PATENT DOCUMENTS

| | | | |
|---|---|---|---|
| 284,009 | 8/1883 | Henry | 301/5.3 |
| 622,391 | 4/1899 | Rankin et al. | 301/5.3 |
| 1,604,643 | 10/1926 | Harlowe | 280/11.22 |
| 1,728,629 | 9/1929 | Sahlmann | 280/11.22 |
| 1,988,055 | 1/1935 | Stein | 280/11.22 |
| 3,228,707 | 1/1966 | Davis et al. | 280/11.23 |
| 4,273,345 | 6/1981 | Ben-Dor et al. | 280/11.2 |
| 4,618,158 | 10/1986 | Liberkowski | 280/843 |
| 5,551,711 | 9/1996 | Mangelsdorf | 280/11.2 |
| 5,560,625 | 10/1996 | Kuykendall | 280/11.2 X |
| 5,716,059 | 2/1998 | Thomas | 280/11.2 |

FOREIGN PATENT DOCUMENTS

| | | | |
|---|---|---|---|
| 2508327 | 12/1982 | France | 280/843 |
| 1031192 | 5/1958 | Germany | 301/5.3 |
| 1569278 | 6/1990 | U.S.S.R. | 301/6 WB |
| 900 | of 1909 | United Kingdom | 301/5.3 |
| 4705 | of 1910 | United Kingdom | 301/5.7 |

*Primary Examiner*—Brian L. Johnson
*Assistant Examiner*—Gary Savitt
*Attorney, Agent, or Firm*—Sughrue, Mion, Zinn, Macpeak & Seas, PLLC

[57] ABSTRACT

Each wheel of an inline roller skate incorporates multiple tires, with a center tire allowing straight-ahead skating and the two side tires allowing maneuvering forces. Leaning the skate such that none of the tires makes good contact with the skating surface causes the skater to skid sideways. By increasing the roll angle, the skater engages more sideways friction of the side tires, and comes to a controlled stop. By modulating the roll angle, a skilled skater can control the rate of deceleration. An added nose wheel allows the skater to tilt toward the toe, like an ice skater, to reduce straight line contact with the skating surface, and enable curvilinear skating.

14 Claims, 4 Drawing Sheets

INLINE ROLLER SKATE AND WHEEL CONSTRUCTION

BACKGROUND OF THE INVENTION

Inline roller skates have met with popularity, enabling many of the advantages of ice skates on almost any even surface at any season of the year. Indeed, dry pucks have appeared on the market, a first step in allowing the game of hockey on inline roller skates.

FIG. 1 shows the starting point, an ice figure skate. The straight portion of the blade 1 makes lengthy contact with the ice, to provide for thrust and gliding. The forward portion of the blade spirals upward, making reduced contact with the ice to allow skating in a curvilinear path and even spinning. The shoe, usually part of the ice skate, is schematically shown but need not detail it here.

FIG. 2 shows the presently available wheeled analog, the inline roller skate. Instead of straight, continuous contact with the skating surface, three or four wheels make straight line contact at the wheel peripheries. The wheels attach to the shoe by way of a yoke 8. This simulates the straight edge portion of the ice skate.

SUMMARY OF THE INVENTION

In accordance with the present invention, each wheel has kind of a spherical shape and incorporates three tires. The center tires perform the function of the wheels in a conventional inline roller skate, while the two side tires allow maneuvering forces. Leaning the skate such that none of the tires makes good contact with the skating surface causes the skater to skid sideways. By increasing the roll angle, the skater engages more sideways friction of the side tires, and comes to a controlled stop. By modulating the roll angle, a skilled skater can control the rate of deceleration. An added nose wheel allows the skater to simulate toe-ward tipping, like an ice skater, to reduce straight line contact with the skating surface, and enable curvilinear skating.

BRIEF DESCRIPTION OF THE DRAWINGS

The reader more clearly may understand the invention from the ensuing descriptions in conjunction with the accompanying drawings, wherein.

DETAILED DESCRIPTION OF THE INVENTION

Figures 1, 2, 3, 4, 5:
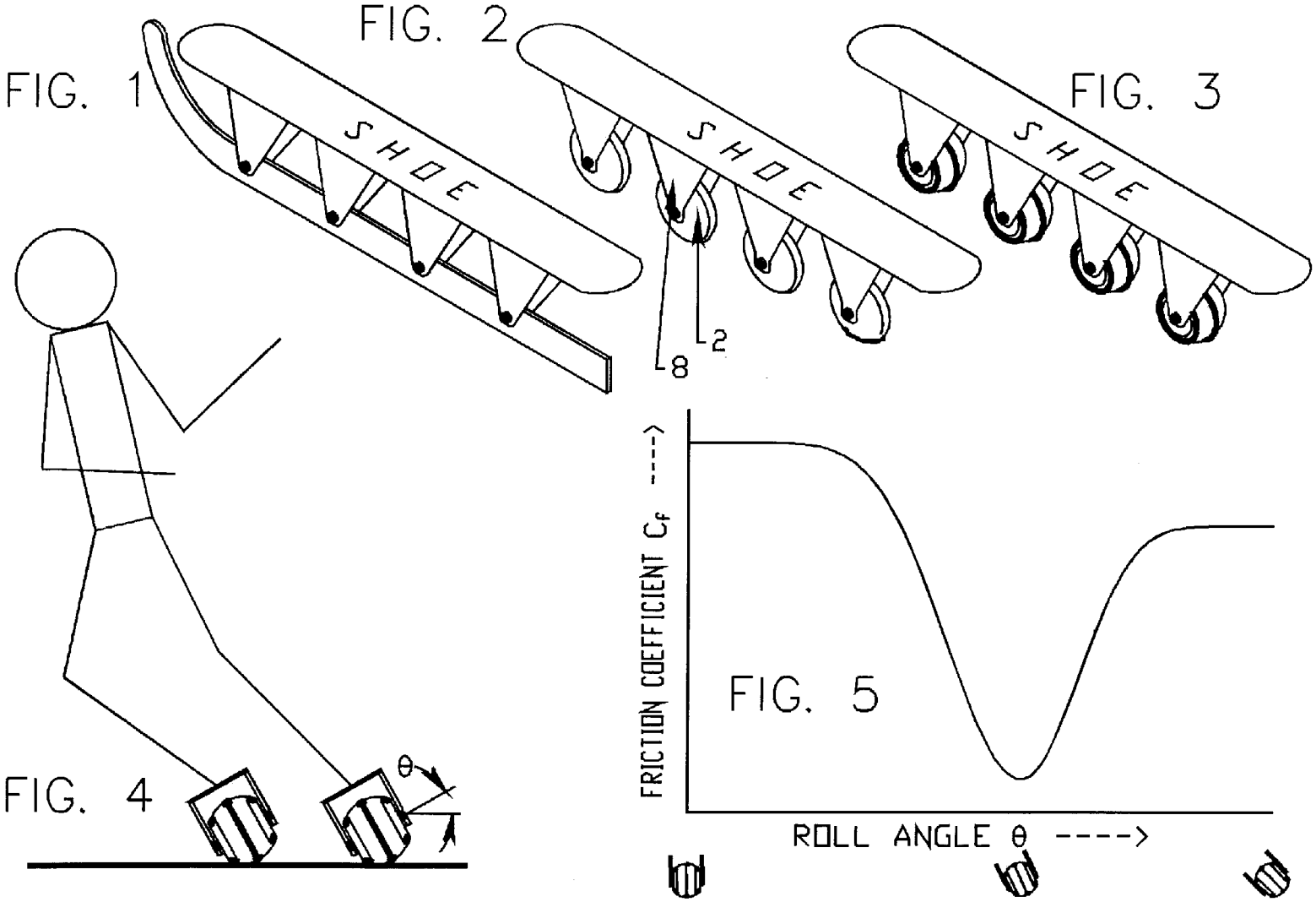
FIG. 1 depicts what inline roller skates try to simulate, the ice skate.
FIG. 2 depicts the conventional inline roller skate simulation of the ice skate.
FIG. 3 depicts a first embodiment of the present invention.
FIG. 4 depicts a hockey stop, a forceful maneuver which the present invention enables for an inline roller skate.
FIG. 5 shows desired variation of sideways friction force as a function of the roll angle θ.

FIG. 3 depicts one form of the present invention. As described below in connection with FIG. 6, each wheel has a generally spherical shape and incorporates three tires. The center tires perform the function of the roller wheels in FIG. 2. The side tires allow maneuvering forces, as described below.

FIG. 4 tries to depict perhaps the most forceful maneuver, the hockey stop. On ice, the skater turns his blades perpendicular to the direction of motion, and performs a controlled skid to a more or less speedy stop. FIG. 4 shows the skater positioned perpendicular to the direction of motion, and turning the roller's roll angle θ such that none of the three tires makes good contact with the skating surface; the skater skids sideways. By increasing the roll angle, the skater engages more sideways friction of the side tires, and comes to a controlled stop.

FIG. 5 graphs schematically the sideways friction force for the invention. At near-zero roll angle, the main, center tires provide maximum sideways friction force and allow regular skate performance. At great roll angle, the side tires provide high sideways friction force and allow sideways high-deceleration skidding. At intermediate roll angle, no tire engages the skating surface; a low friction coefficient material allows sideways skidding with little deceleration. As FIG. 5 shows, a portion of the friction graph has a rising profile of sideways friction force. By modulating the roll angle, a skilled skater can control the rate of deceleration. The rising profile enables stable control.

Figure 14:
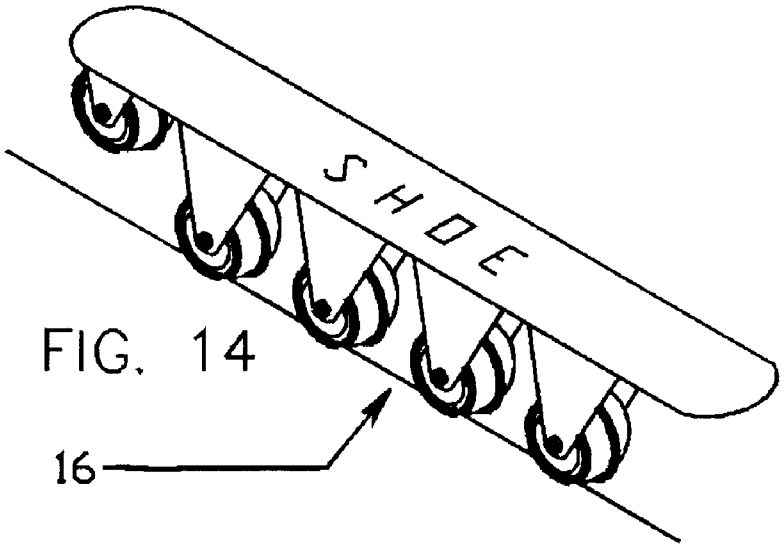
FIG. 14 depicts an added invention to provide skating in a curvilinear path.
Figure 15:
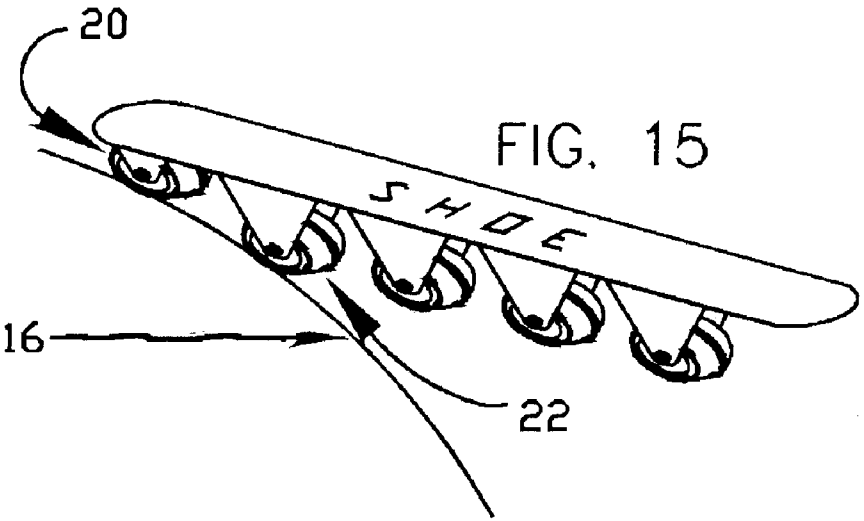
FIG. 15 depicts the invention of FIG. 14 in its toe down position for curvilinear skating.

FIGS. 14 and 15 depict a second attribute of the invention. An added nose wheel allows the skater to simulate tipping toward the toe, like an ice skater, to reduce straight line contact with the skating surface, and enable curvilinear skating.

Figure 6:
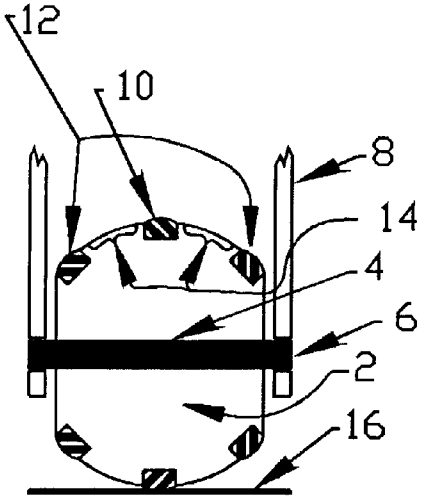
FIG. 6 shows the roller detail for a first embodiment of the present invention.

FIG. 6 shows the important features of the present invention. The wheel 2 has zero roll angle θ, as detailed in FIG. 7. At this angle the rolling tire 10 has full contact with the skating surface or ground 16. A skid/stop tire 12 occupies a place on either side of the rolling tire. Between the rolling and skid/stop tires there exist slip-surfaces 14. The wheel rotates on the axle 4, affixed to the bearing 6, affixed to the yoke 8, finally attached to the skate's shoe.

Figure 7:
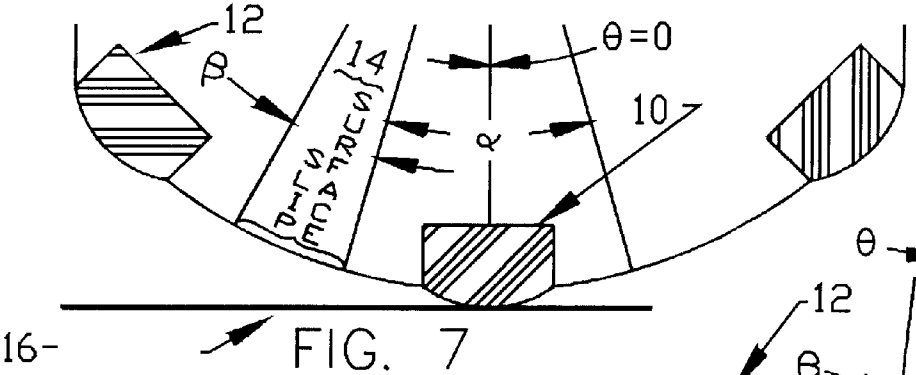
FIG. 7 shows the roller of FIG. 6 at zero roll angle.

FIG. 7 depicts an enlarged portion of the wheel 2 of the present invention. Here the wheel has near-zero roll angle θ; only the rolling tire 10 makes (conventional) contact with the ground 16. Neither the slip-surfaces nor the skid/stop tires play a role.

Figure 8:
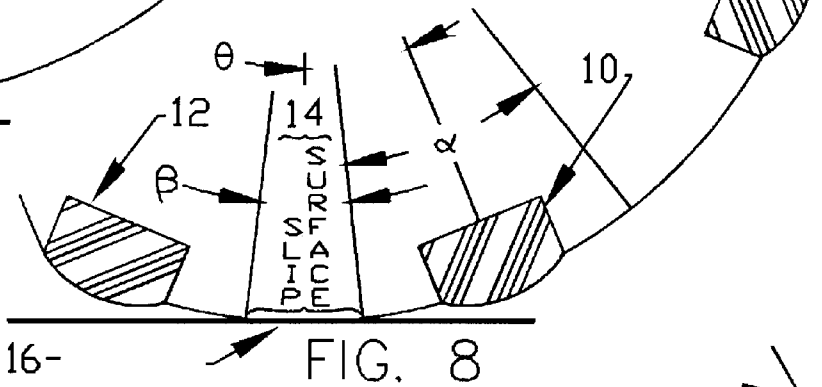
FIG. 8 shows the roller of FIG. 6 at an intermediate roll angle which provides minimal sideways friction force with the skating surface.

FIG. 8 depicts the wheel of FIG. 7 at an intermediate roll angle θ such that no tire (10 or 12) contacts the ground 16. Only the slip-surface 14 makes contact. There exists minimal sideways friction force; one can embark on the hockey stop maneuver. On usual dry surfaces (e.g., asphalt, concrete or macadam) a hard steel slip-surface may do. On softer surfaces (e.g., wooden) one might prefer a softer slip-surface material, such as Teflon (polytetrafluoroethylene).

Figure 9:
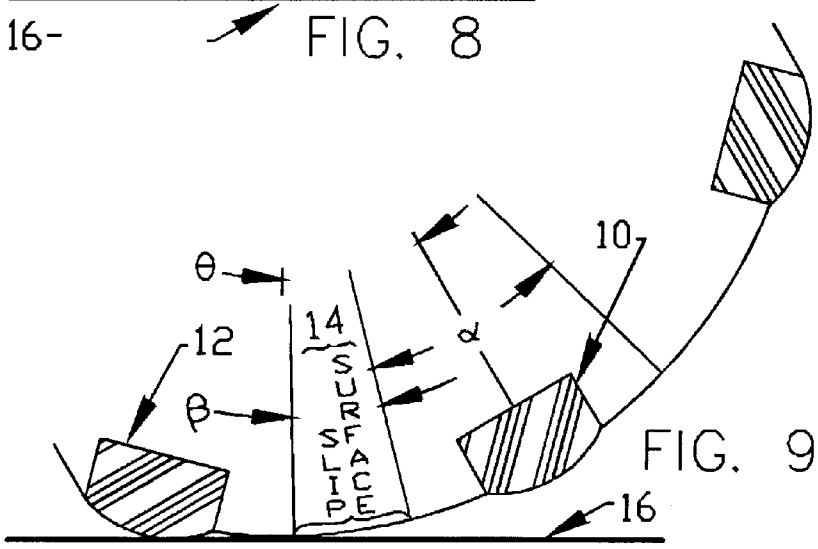
FIG. 9 shows the roller of FIG. 8 at an increased roll angle such that sideways friction force begins to increase.

FIG. 9 depicts the wheel of FIG. 8 at increased roll angle θ such that the skid/stop tire 12 makes heavy contact while the slip-surface 14 begins to recede from the ground 16. As the roll angle θ increases further, the sideways friction force increases, providing the rising profile so that a skater has stable control over the stopping maneuver.

The wheel of FIG. 6 has the slip-surfaces 14 as part of the wheel 2. The slip-surfaces roll with the wheel, but nonetheless provide minimal sideways frictional force. FIG. 3 shows the wheels of FIG. 6 attached to the skate via several yokes.

Figure 10:
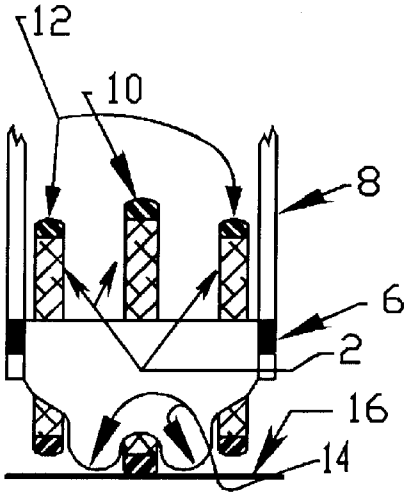
FIG. 10 shows the detail for a second embodiment of the present invention.

FIG. 10 depicts a second embodiment of the present invention. The operation as described in FIGS. 6 through 9 still holds. As the essential difference, FIG. 10 shows the slip-surface 14 no longer part of the wheel, but rather attached directly to the yoke 8. This configuration provides for a long straight line of slip-surface contact with the ground and would seem less likely to dig in or gouge the skating surface. Further, the wheel bearings need no longer transmit the slip-skid forces.

Figure 11:
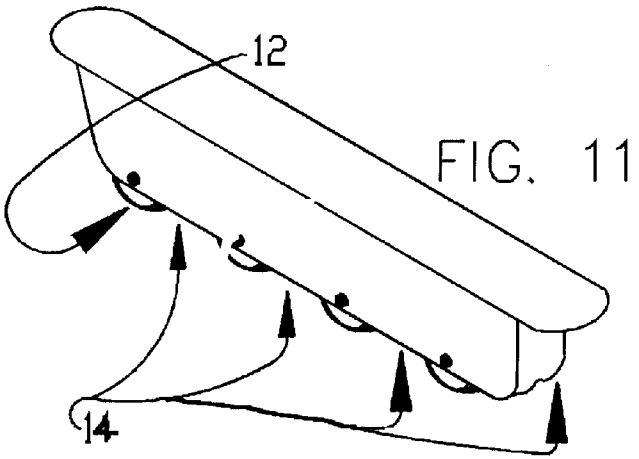
FIG. 11 depicts the embodiment of FIG. 10 emplaced on the skate.

FIG. 11 shows that the embodiment of FIG. 10 may attach to the skate by means of a combined long, perhaps continuous slip-surface and yoke.

Figure 13:
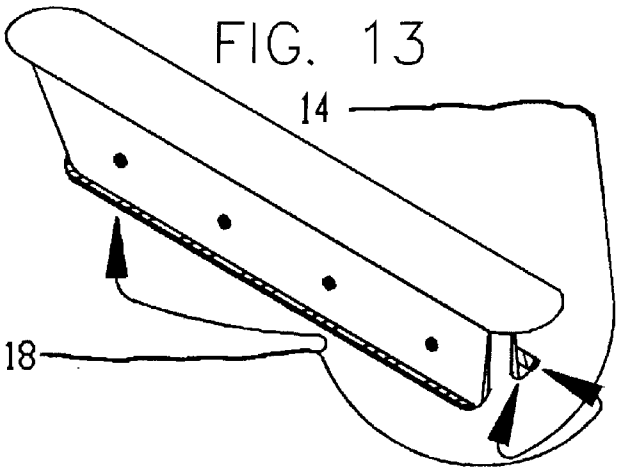
FIG. 13 depicts the embodiment of FIG. 12 emplaced on the skate.
Figure 12:
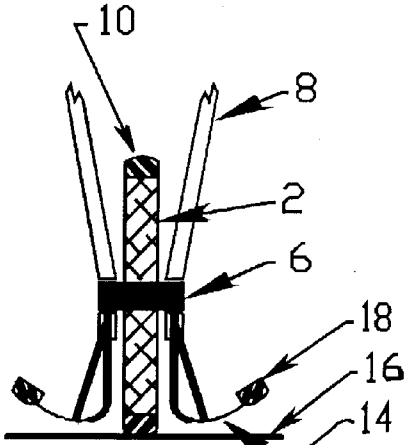
FIG. 12 shows the detail for a third embodiment of the present invention.

FIG. 12 depicts a third embodiment of the present invention. The wheel 2 incorporates only the rolling tire 10. But now, skid/stop pad 18 replaces the skid/stop tire 12 of FIG. 10. Both the skid/stop pad and slip-surface attach to the yoke and thus to the skate, as shown in FIG. 13. Like the slip-surface 14 in FIG. 10 there is a long straight line of skid/stop pad contact with the ground 16. For a skater continually using severe maneuvers or skating on hard and soft surfaces, one may offer replaceable and/or interchangeable slip-surfaces and skid/stop pads.

For possibly bumpy skating surfaces, a compliant slip-surface helps. FIG. 12 shows a simple form: slip-surface 14 made of spring steel, and offering a cantilevered form of attachment for the skid/stop pad 18. For any of the embodiments, those skilled in the art readily can devise ways to provide compliant attachment for slip-surfaces and skid/stop means.

To enable figure skating performance, a raised nose wheel 20 is added as depicted in FIGS. 14 and 15. By tilting toward the toe the skater removes the straight line contact of the several wheels and replaces it with contact only by the nose wheel 20 and the first wheel 22. Strictly speaking, unless the nose wheel has a castered attachment to the skate, the two contacting wheels do not exactly enable skating in a curvilinear path. In practice the first wheel 22 carries most of the skater's weight; the nose wheel 20 carries just enough weight to offer balance, otherwise it skids somewhat.

I claim:

1. An inline roller skate for skating along a skating surface, said skate comprising:

a longitudinally extending frame having first and second opposite sides;

wheel means including at least one wheel attached to said frame and constrained for rotation between said first and second sides about a single fixed wheel axis, said wheel means including at least a first rolling surface rotatable about said wheel axis;

skid means attached to said frame including a first sliding surface extending laterally from the first side of said frame and a second sliding surface extending laterally from the second side of said frame; and brake means including a first brake member attached to an outermost lateral edge of said first sliding surface and a second brake member attached to an outermost lateral edge of said second sliding surface, said first and second sliding surfaces contacting said skating surface only after said skate has been tilted in first and second opposite directions respectively to within a predetermined angular range of tilt relative to said skating surface, said first and second brake members contacting said skating surface only after said skate has been tilted beyond said predetermined angular range of tilt in said first and second directions respectively, each of said first and second sliding surfaces having a lower coefficient of friction than said first rolling surface.

2. A skate according to claim 1, comprising a nose wheel mounted at a forward end of said skate in a direction of travel of said skate and contacting said skating surface only when said skate is tilted toward said direction of travel of said skate.

3. An inline roller skate for skating along a skating surface, said skate comprising:

a longitudinally extending frame; and wheel means including at least one wheel attached to said frame, each wheel constrained for rotation about a single fixed wheel axis and each wheel including a first rolling surface rotatable about said wheel axis, a second rolling surface disposed to one lateral side of said first rolling surface along said wheel axis, and a third rolling surface disposed on an opposite lateral side of said first rolling surface along said wheel axis, each wheel further including a first sliding surface disposed between said first and second rolling surfaces and a second sliding surface disposed between said first and third rolling surfaces, said first and second sliding surfaces contacting said skating surface only after said skate has been tilted in first and second opposite directions respectively to within a predetermined angular range of tilt relative to the skating surface, said second and third rolling surfaces contacting said skating surface only after said skate has been tilted beyond said predetermined angular range of tilt in said first and second directions respectively, each of said first and second sliding surfaces having a lower coefficient of friction then each of said first, second and third rolling surfaces.

4. A skate according to claim 3, wherein said sliding surfaces are of a compliant material.

5. A skate according to claim 3, wherein said wheel means includes a plurality of wheels each having a rolling first surface.

6. A skate according to claim 5, further comprising a nose wheel mounted at a forward end of said skate in a direction of travel of said skate and contacting said skating surface only when said skate is tilted toward said direction of travel of said skate.

7. A skate according to claim 6, wherein said nose wheel is rotatable about an axis of rotation parallel to said single fixed wheel axis.

8. A skate according to claim 3, wherein said sliding surfaces are nonrotatable with respect to said first, second and third rolling surfaces.

9. An inline roller skate for skating along a skating surface, said skate comprising:

a longitudinally extending frame having first and second opposite sides;

a plurality of longitudinally spaced wheel assemblies, each wheel assembly having first, second and third laterally spaced wheels attached to said frame and constrained for rotation about at least one wheel axis, each of said first, second and third wheels having first, second and third rolling surfaces respectively which are rotatable about at least one wheel axis; and skid means including a plurality of skid members attached to said frame with at least one wheel assembly positioned between said skid members, each skid member having first and second laterally opposed sliding surfaces, said first and second sliding surfaces contacting said skating surface only after said skate has been tilted in first and second opposite directions respectively to within a predetermined angular range of tilt relative to said skating surface, said second and third rolling surfaces contacting said skating surface only after said skate has been tilted beyond said predetermined angular range of tilt in said first and second directions respectively, each of said first and second sliding surfaces having a lower coefficient of friction than said first, second and third rolling surfaces.

10. A skate according to claim 9, wherein said sliding surfaces are of a compliant material.

11. A skate according to claim 9, wherein said first, second and third wheels are rotatable about a common wheel axis.

12. A skate according to claim 9, wherein said sliding surfaces are nonrotatable with respect to said wheel assemblies.

13. A skate according to claim 9, further comprising a nose wheel mounted at a forward end of said skate in a direction of travel of said skate and contacting said skating surface only when said skate is tilted toward said direction of travel of said skate.

14. A skate according to claim 13, wherein said nose wheel is rotatable about an axis of rotation parallel to the wheel axes of said wheel assemblies.

* * * * *